United States Patent [19]

Johnson

[11] Patent Number: 4,462,031

[45] Date of Patent: Jul. 24, 1984

[54] TRAFFIC SYNCHRONIZATION DEVICE

[75] Inventor: Wilbur E. Johnson, Anaheim, Calif.

[73] Assignee: Econolite Control Products, Inc., Anaheim, Calif.

[21] Appl. No.: 460,117

[22] Filed: Jan. 21, 1983

[51] Int. Cl.[3] ..... G08G 1/07; G08B 1/00

[52] U.S. Cl. ..... 340/916; 340/913; 340/309.15

[58] Field of Search ..... 340/41 R, 46, 40, 35, 340/309.15, 916, 913, 909; 364/436

[56] References Cited

U.S. PATENT DOCUMENTS

| | | | |
|---|---|---|---|
| 3,763,466 | 10/1973 | Howard | 340/41 R |
| 3,810,084 | 5/1974 | Hoyt | 340/41 R |
| 4,061,902 | 12/1977 | Battle | 340/41 R |

*Primary Examiner*—James J. Groody

*Attorney, Agent, or Firm*—Edward A. Sokolski

[57] ABSTRACT

A synchronization device for the control of an automobile traffic signal in synchronization with other traffic signals in the system. A present time clock in the device operates from the local alternating current power source. The synchronization device calculates the time difference between the present time and a daily re-synchronization time, divides that time difference by the length of the operating cycle of traffic signal, and generates a synchronization pulse whenever the residue of the division is zero. An offset or time-delay is added to the synchronization pulse and the traffic signal is operated in response to the delayed synchronization pulse so as to operate with the desired time delay in coordination with the other signals in the system.

1 Claim, 1 Drawing Figure

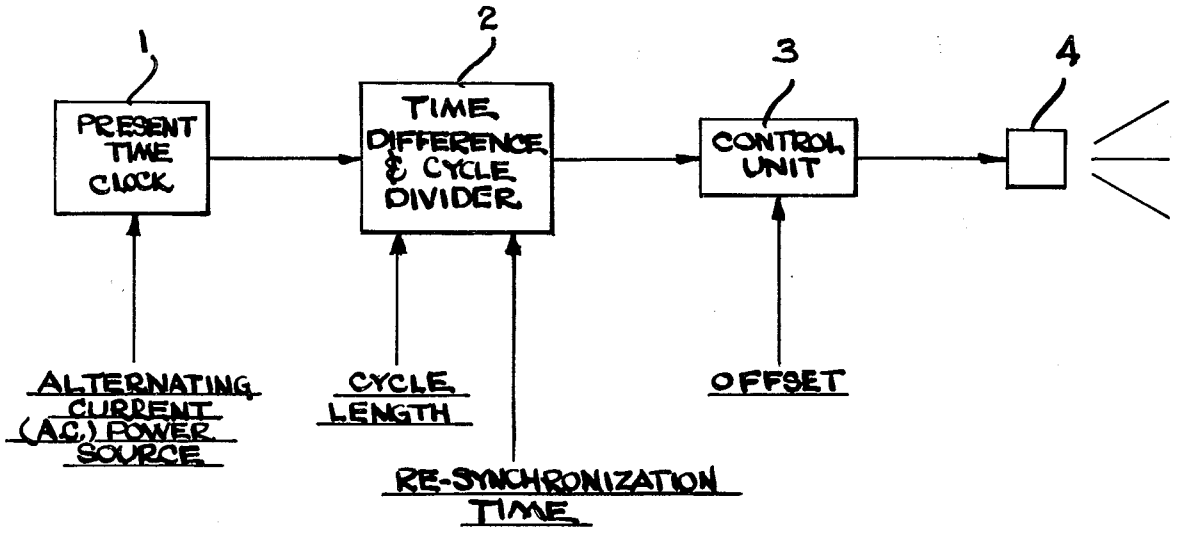
1
PRESENT TIME CLOCK
2
TIME DIFFERENCE & CYCLE DIVIDER
3
CONTROL UNIT
4
ALTERNATING CURRENT (AC) POWER SOURCE
CYCLE LENGTH
RE-SYNCHRONIZATION TIME
OFFSET

TRAFFIC SYNCHRONIZATION DEVICE

BACKGROUND OF THE INVENTION (1) Field of the Invention

This invention pertains to devices for the control and synchronization of automobile traffic signals. More particularly, this invention pertains to synchronization devices which use the cycles of the alternating current power source, nominally 60 hz, as a common time reference to maintain the operating cycles of a series of traffic signals in synchronization and to maintain fixed time delays between the various traffic signals to coordinate the traffic flow.

(2) Description of the Prior Art

Synchronization devices in the prior art use a digital counter to count the cycles of the alternating current power source to provide a common time reference. When the counter reaches a number corresponding to the length of the traffic light operating cycle the counter re-sets to zero and starts counting again. In the prior art the cycle counters in all of the synchronized traffic control devices are re-set once a day to zero by a system wide, time of day, re-synchronization pulse. Offsets or time-delays between the operating cycles of individual traffic signals are obtained by generating a synchronizing pulse from the cycle counter whenever the cycle counter reaches an intermediate count corresponding to the desired offset or time-delay for the particular traffic signal. This synchronization pulse, in turn, initiates and times the operating cycle of the individual traffic signal.

A problem arises in the operation of the prior art device whenever the length of the operating cycle of the traffic light is altered. After the cycle length in each light is altered, each cycle counter in the traffic control system must wait for the next daily re-synchronization pulse before the system is again synchronized.

SUMMARY OF THE INVENTION

The traffic synchronization device described in this specification need not wait for the system re-synchronization pulse to become synchronized with the system. This device uses a "present time" counter, or clock, which is synchronized by the re-synchronization pulse once a day and which maintains a local time reference. A computer in the traffic synchronization device calculates the difference between the present time and the re-synchronization time, divides that difference by the length of the traffic signal operating cycle and outputs a synchronization pulse to the traffic control unit whenever the residue of the division is zero. The local offset or time-delay in the operation of the traffic signal is added in the control unit to the time of the synchronization pulse so as to obtain the desired time delay in the operation of the traffic signal. Since the "present time" clock is not disturbed by a change of cycle length, all of the synchronization pulses generated in the control units in which the cycle lengths have been altered are immediately in synchromism with each other. As a consequence, the system of traffic signals need not wait for the daily synchronizing pulse to be re-synchronized.

BRIEF DESCRIPTION OF THE DRAWINGS

The sole FIGURE is a functional block diagram of the invention.

DESCRIPTION OF THE PREFERRED EMBODIMENT

The sole FIGURE is a functional block diagram of the synchronization device. Present time clock 1 counts a string of pulses that is synchronized to the alternating current (a.c.) electrical power source to determine the passage of time and outputs, in digital format, the date and time of day. A device such as an OKI MSM 5832 or a National MM 58174 semiconductor may be used for this purpose. Time Difference and Cycle Divider 2 subtracts the predetermined re-synchronization time (typically midnight) from the output of the present time clock, i.e., the time of day, to obtain the time that has elapsed since the re-synchronization time. Time Difference and Cycle Divider 2 then divides this elapsed time by the operator-specified length of the traffic signal operating cycle, i.e., by the cycle length. Whenever the elapsed time is equal to a whole number of cycle lengths, that is whenever, the residue of the division of the elapsed time by the cycle length is zero, Time Difference and Cycle Divider 2 outputs a timing or synchronization pulse to Control Unit 3. Control Unit 3 then adds an operator-specified offset or time-delay to the synchronization pulse and operates the traffic signal in synchronization with the delayed synchronization pulse.

In practice, the functions of Time Difference and Cycle Divider 2 and Control Unit 3 are performed by a microprocessor such as the Motorola 6802/6808. The sequence of microprocessor steps for the calculation of the elapsed time (from the re-synchronization time), its division by the cycle length, and the addition of the time delay or offset are contained in a computer program located in a random access memory connected to the microprocessor.

When the traffic signal operating cycle length is changed at some time during the day at various units in the system, the synchronization or offset between the various traffic lights is not affected because the synchronizing pulse output by Time Difference and Cycle Divider 2 at each traffic light for which the cycle length has been changed, remains synchronized with the pulses output by the Time Difference and Cycle Dividers in each of the other synchronization devices for which the cycle length also has been changed. As a consequence, there is no need to wait for the daily re-synchronization pulse to regain synchronization between traffic lights for which the operating cycle length has been changed.

I claim:

1. A device for the synchronization of the control unit of a traffic signal supplied by alternating current (a.c.) electrical power comprising (a) present time clock means for determining the time of day, which present time clock means is synchronized with the a.c. electrical power, (b) time difference means for calculating the difference between the time of day and a specified re-synchronization time, (c) cycle divider means for calculating the residue of the division of said time difference by a specified operating cycle length, (d) pulse means for generating and outputting a synchronizing pulse when said residue is zero, (e) control unit means for adding a time offset to the synchronizing pulse from the pulse generating means and for controlling the traffic signal in response to the offset synchronizing pulse.

* * * * *